United States Patent [19]

Bargigia et al.

[11] Patent Number: 4,620,946

[45] Date of Patent: Nov. 4, 1986

[54] COMPOSITIONS BASED ON 1,1,2-TRICHLOROTRIFLUOROETHANE FOR INDUSTRIAL WASHING

[75] Inventors: Gianangelo Bargigia, Milan; Mauro Scapin, Busto Arsizio, both of Italy

[73] Assignee: Montefluos S.p.A., Milan, Italy

[21] Appl. No.: 708,576

[22] Filed: Mar. 5, 1985

[30] Foreign Application Priority Data

Mar. 7, 1984 [IT] Italy ..... 19925 A/84

[51] Int. Cl.[4] ..... C11D 1/22; C11D 7/30; C11D 7/50

[52] U.S. Cl. ..... 252/545; 252/153; 252/171; 252/558

[58] Field of Search ..... 252/153, 170, 171, 558, 252/162, DIG. 14, 194, 364, 545

[56] References Cited

U.S. PATENT DOCUMENTS

| | | | |
|---|---|---|---|
| 3,336,232 | 8/1967 | Bauer et al. | 252/153 |
| 3,355,391 | 11/1967 | Eiseman | 252/153 |
| 3,539,522 | 10/1970 | Linder | 252/153 |
| 3,872,021 | 3/1975 | McKnight | 252/121 |
| 3,926,862 | 12/1975 | Figiel et al. | 252/546 |
| 4,438,026 | 3/1984 | Tajkowski | 252/545 |

FOREIGN PATENT DOCUMENTS 971456 7/1975 Canada .

*Primary Examiner*—Prince E. Willis

[57] ABSTRACT

Compositions suitable to be used for washing of industrial materials, comprising, by weight:

63–99% of 1,1,2-trichloro-1,2,2-trifluoroethane 0.5–25% of water 0.5–12% of a mixture consisting of 80–97% by weight of a compound of formula (I) and of 20–3% by weight of a compound of formula (II)

$$R—C_6H_5—SO_3H.A \quad (I)$$

wherein:

R = an alkyl group $C_9$–$C_{15}$

A = an aliphatic or cyclic amine $$X—(CO)_n—OH \quad (II)$$

wherein:

n = 0 or 1

X = an alkyl or an alkenyl group, $C_6$–$C_{25}$.

8 Claims, No Drawings

COMPOSITIONS BASED ON 1,1,2-TRICHLOROTRIFLUOROETHANE FOR INDUSTRIAL WASHING

THE PRIOR ART

The properties of the chlorofluorinated solvents, in particular the ones of 1,1,2-trichloro-1,2,2-trifluoroethane, for removing oily and fatty substances from the surfaces of metal and/or plastic objects, coming from intermediate stages of the processing, are known, as well as the delicacy is known of the cited solvents towards the construction materials.

For particular cases, special mixtures were perfected wherein, to the main chlorofluorocarbide component, other solvents were added, capable of bestowing particular properties on the main component, without changing, however, its essential characteristics.

For instance, azeotropic mixtures 1,1,2-trichloro-1,2,2-trifluoroethane-methanol; 1,1,2-trichloro-1,2,2-trifluoroethane-ethanol; 1,1,2-trichloro-1,2,2-trifluoroethane-isopropanol; 1,1,2-trichloro-1,2,2-trifluoroethane-methylene chloride have been described.

In the particular case of 1,1,2-trichloro-1,2,2-trifluoroethane, a mixture thereof with water was also suggested, so that, in the washing operations, it was possible to remove by means of a single operation besides the dirts of fatty nature, the ones of salty nature as well.

As, however, a simple physical mixture was not suited to the purpose, one obviated by adding particular surfactants which, by promoting the formation of stable emulsions of the kind water in oil, give rise to efficacious limpid mixtures.

In this connection the use was described, as surfactants, of isopropylammonium dodecylbenzenesulfonate (British Pat. No. 1.019.859), of aminic salts of undecyl—or tridecylbenzenesulfonic acids (British Pat. No. 1.258.757), of mixtures of salts between alkyl and dialkyl phosphoric acids and amines (British Pat. No. 1.499.271) and lastly of sodium, ammonium or alkylammonium salts of monosulfonic acid coming from the diester of a succinic acid (British Pat. No. 1.157.190).

The hitherto used surfactants, present the drawback not to fulfil completely the requirements of biodegradability, or to be found with difficulty or to be expensive as far as their preparation is concerned.

THE PRESENT INVENTION

An object of the present invention is to place at disposal for industrial washing a functional product, whose elimination is not dangerous for the environment.

Another object of the present invention is to allow the employ, performances being equal, of lower amounts of a same surfactant.

This is obtained, according to the present invention, by using in the washing compositions comprising 1,1,2-trichloro-1,2,2-trifluoroethane and water, an additive consisting of a mixture of an alkylammonium benzenesulfonate having general formula:

$$R—C_6H_5—SO_3H.A \qquad (I)$$

wherein:

R is a linear or branched alkyl group having from 9 to 15, but preferably from 11 to 13 carbon atoms;

A may be:

(a) a primary, secondary or tertiary, linear or branched, aliphatic or cyclic amine, having from 2 to 8 carbon atoms, but preferably a branched primary aliphatic amine containing 3 or 4 carbon atoms, or a primary cyclic amine; or, (b) a diamine having general formula $$H_2N—B—NH_2$$

wherein:

B = an alkylene group containing from 3 to 12 carbon atoms, or (c) a polyamine having general formula:

$$NH_2—CH_2—CH_2—(NH—CH_2—CH_2)_m—NH_2$$

wherein m = a whole number, comprised between 1 and 4, extremes included, with at least a compound (defined as coadjuvant agent) comprised in general formula $$X—(CO)_n—OH \qquad (II)$$

wherein n is 1 or zero and wherein X is a linear, branched or cyclic alkyl or alkenyl group containing from 6 to 25 carbon atoms and preferably from 8 to 20 carbon atoms.

In particular, such a mixture, that forms the additive, comprises from 80% to 97%, but preferably from 88% to 94% by weight of at least a compound of formula (I) and from 20% to 3%, and preferably from 6 to 12% by weight, of at least a compound of general formula (II).

Therefore the washing compositions, forming the object of the present invention, comprise:

(a) from 63% to 99%, but preferably from 79% to 97.5% by weight of 1,1,2-trichloro-1,2,2-trifluoroethane;

(b) from 0.5% to 25%, preferably from 1.5 to 15% by weight of water;

(c) from 0.5% to 12%, preferably from 1% to 6% by weight, of a mixture consisting, for 80%–97% by weight, of at least a compound of formula (I) and, for 20%–3% by weight, of at least a compound of formula (II).

Preferably, in general formula (I) R is an undecyclic, dodecyclic, tridecyclic, radical linear or having various branch degrees, whereas A is isopropylamine or t.butylamine.

The class of compounds of formula (II) includes the saturated or unsaturated linear, branched or cyclic carboxylic acids, among which the saturated or unsaturated, linear or branched fatty acids, containing on the whole from 12 to 18 carbon atoms, are particularly preferred.

The linear or branched aliphatic or cycloaliphatic alcohols are included in said formula (II) as well. Among them, alcohols containing from 8 to 16 carbon atoms are particularly preferred.

Typical examples of compounds comprised in general formula (II) are:

5-decanol
1-dodecanol
1-octadecanol
1-tetradecanol
cyclohexanol
methylcyclohexanol
5-nonanol
2-octanol myristic acid
oleic acid
cyclohexanecarboxylic acid
and preferably: 1-octanol, 1-hexadecanol, 1-nonanol, stearic acid, lauric acid, 9-octadecene-1-ol, 1-decanol.

The compositions, according to the invention, retain water in the form of an emulsion, stable along the time and they do not undergo any negative alteration due to the addition of optional substances, such as for instance nitromethane, introduced as stabilizing agents, if required by the materials to be washed.

The employable modalities of the compositions, according to the present invention, are analogous to the ones already known for products which can be found on the market, but which are, however, lacking in the requisites characterizing the compositions according to the present invention.

The same considerations are valid as far as the nature of the objects to be washed is concerned.

The following examples will illustrate the scope of the present invention without, however, limiting it. The tests are carried out at room temperature, unless otherwise specified.

EXAMPLE 1

Isopropylammonium dodecylbenzenesulfonate was prepared by employing isopropylamine and a dodecylbenzenesulfonic acid produced by Marchon Company, characterized (through $^1$HNMR test) in having a ratio: H atoms on $CH_3$/total aliphatic H atoms=0.24 and moreover in having a biodegradability of 99.0% (according to the rules of ministerial decree of July 19, 1974).

Said preparation was carried out by mixing equimolecular amounts of the reactants, both of them dissolved at 20% in trichlorotrifluoroethane, and by evaporating the solvent.

Weighed amounts of dodecylbenzenesulfonate prepared as described hereinbefore and 1-decanol, the latter in an amount by weight equal to 10/90 of the dodecylbenzenesulfonate, were introduced into a 100 ml flask. Then so much 1,1,2-trichloro-1,2,2-trifluoroethane was added, that a weight of 100 g was reached and the whole was stirred till dissolution.

Keeping the solution under stirring, by means of a graduated burette, deionized water was added slowly till it was dissolved and one stopped when a stable opalescence appeared. By working exactly as described hereinbefore, the test was repeated without addition of 1-decanol.

The results of carried out tests are recorded on Tables I and II.

TABLE I

| Test No. | g of additive (comprising dodecylbenzenesulfonate and 1-decanol) contained in 100 g of solution in trifluoroethane | g of water dissolved by 100 g of composition 1,1,2-trichloro-1,2,2- |
|---|---|---|
| 1 | 0.5 | 1.4 |
| 2 | 1.0 | 3.0 |
| 3 | 2.0 | 7.5 |
| 4 | 2.6 | 10.7 |

TABLE II

| Test No. | g of surfactant (dodecylbenzenesulfonate contained in 100 g of solution in 1,1,2-trichloro-1,2,2-trifluoroethane | g of water dissolved by 100 g of the composition free from 1-decanol |
|---|---|---|
| 5 | 0.5 | 1.1 |
| 6 | 1.0 | 2.2 |
| 7 | 2.0 | 4.9 |
| 8 | 2.6 | 6.4 |

EXAMPLE 2

As described in Example 1, solutions in 1,1,2-trichloro-1,2,2-trifluoroethane of the same isopropylammonium dodecylbenzenesulfonate and of the same 1-decanol were prepared. In each test (recorded on Table III) the solutions contained 1% by weight of an additive consisting of mixtures of dodecylbenzenesulfonate and 1-decanol, respectively in ratios by weight 100/0; 99/1; 95/5; 90/10.

The amount of water emulsifiable by each solution is recorded on the Table.

TABLE III

| Test No. | ratio by weight surfactant/ /coadjuvant agent | g of water dissolved by 100 g of composition |
|---|---|---|
| 1 | 100/0 | 2.2 |
| 2 | 99/1 | 2.3 |
| 3 | 95/5 | 2.7 |
| 4 | 90/10 | 3.0 |

EXAMPLE 3

By means of the same sulfonic surfactant of Example 1, additives were prepared consisting of 90 parts by weight of surfactant and 10 parts by weight of various coadjuvant agents.

Into a 100 ml flask, containing 98 g of 1,1,2-trichloro-1,2,2-trifluoroethane and 2 g of additive, kept under stirring, water was added till saturation.

Below recorded Table IV shows the obtained results.

TABLE IV

| Test No. | coadjuvant agent | g of water dissolved by 100 g of composition |
|---|---|---|
| 1 | 1-octanol | 7.3 |
| 2 | 5-nonanol | 5.4 |
| 3 | 1-hexadecanol | 6.5 |
| 4 | stearic acid | 6.3 |
| 5 | lauric acid | 6.7 |
| 6 | 2-octanol | 5.7 |
| 7 | 9-octadecene-1-ol (mixture of isomers) | 6.0 |
| 8 | methylcyclohexanol | 5.1 |
| 9 | 1-nonanol | 7.4 |
| 10 | 1-dodecanol | 7.1 |

EXAMPLE 4

By means of the same dodecylbenzenesulfonic acid of Example 1 and by means of terbutylamine the respective dodecylbenzenesulfonate was prepared.

Following the conditions of Example 3, a solution was prepared, in 1,1,2-trichloro-1,2,2-trifluoroethane, of the additive consisting of terbutylammonium dodecylbenzenesulfonate and 1-decanol and the amount of emulsifiable water was measured.

The same test was repeated without using 1-decanol. The results are recorded on Table V.

TABLE V

| Test No. | | g of water dissolved by 100 g of composition |
|---|---|---|
| 1 | additive with 1-decanol | 6.7 |
| 2 | additive with 1-decanol | 5.1 |

EXAMPLE 5

One worked as described in Example 1 with the difference that use was made of a dodecylbenzenesulfonic acid characterized in having a ratio: H atoms on $CH_3$/total aliphatic H atoms=0.41, as determined through $^1H$ NMR, and characterized in having a biodegradability of 80.0%.

The test results are shown in following Tables VI and VII.

TABLE VI

| Test No. | g of additive (comprising dodecylbenzenesulfonate and 1-decanol) contained in 100 g of solution in 1,1,2-trichloro-1,2,2-trifluoroethane | g of water dissolved by 100 g of composition |
|---|---|---|
| 1 | 2.0 | 8.0 |
| 2 | 2.9 | 15.0 |

TABLE VII

| Test No. | g of surfactant (dodecylbenzenesulfonate) contained in 100 g of solution in 1,1,2-trichloro-1,2,2-trifluoroethane | g of water dissolved by 100 g of the composition free from 1-decanol |
|---|---|---|
| 3 | 2.0 | 6.6 |
| 4 | 2.9 | 9.8 |

EXAMPLE 6

One worked as described in Example 1 with the difference that use was made of a dodecylbenzenesulfonic acid produced by Arca Company, characterized in having a ratio H atoms on $CH_3$/total aliphatic H atoms=0.24, as determined through $^1H$ NMR, and characterized in having a biodegradability of 99.0%.

The test results are shown in following Tables VIII and IX.

TABLE VIII

| Test No. | g of additive (comprising dodecylbenzenesulfonate and 1-decanol) contained in 100 g of solution in 1,1,2-trichloro-1,2,2-trifluoroethane | g of water dissolved by 100 g of composition |
|---|---|---|
| 1 | 1.5 | 5.9 |
| 2 | 2.2 | 9.0 |

TABLE IX

| Test No. | g of surfactant (dodecylbenzenesulfonate) contained in 100 g of solution in 1,1,2-trichloro-1,2,2-trifluoroethane | g of water dissolved by 100 g of the composition free from 1-decanol |
|---|---|---|
| 3 | 1.5 | 3.5 |
| 4 | 2.2 | 5.1 |

EXAMPLE 7

The suitable tank of an ultra-sound machine for washing objects of small size was filled up with the composition described in Test 2 of Example 6.

After having started the ultra-sound generator, by means of a small stainless steel object-supporting basket or in case by means of hooks, the following objects were introduced:

1. Metal, brass or stainless steel, pieces, coming from turning operations and sprinkled during the processing with an emulsion mineral oil/network water used as a lubricating and refrigerating agent.

2. Slides for microscope and optical lenses with signs of fingerprints; slides for microscope, dirtied purposely by immersion into concentrated salt solutions and, after drying, furthermore dirtied with mineral oil.

3. A Bremas commutator model 10A, after having been used and disassembled for overhauling.

4. An auxiliary relay with 5 commutating contacts, RIA-MTI-Italy make, after having been used and disassembled for overhauling.

5. A Siemens temperature relay, after having been used and disassembled for overhauling.

6. An one-phase asynchronous motor, Arduini make, after having been used and disassembled for overhauling.

7. A type-holder device of an Olivetti typewriter. The time required for washing varied from 1' to 5', depending on the complexity and on the dirt degree of the piece.

After the washing operation the pieces were rinsed away twice in pure 1,1,2-trichloro-1,2,2-trifluoroethane kept at boiling temperature, and lastly they were kept for about 1' within the solvent vapors.

All the pieces thus treated resulted to be perfectly clean.

Pieces 3,4,5,6, after having been reassembled in their respective electric circuit, ran regularly.

What I claim is:

1. Compositions suitable to be used for industrial washing, comprising by weight:

(a) from 63% to 99% of 1,1,2-trichloro-1,2,2-trifluoroethane;

(b) from 0.5% to 25% of water;

(c) from 0.5% to 12%, of a mixture consisting of 80%–97% by weight of at least a compound having formula:

$$R—C_6H_5—SO_3H.A \quad (I)$$

wherein R is a linear or branched alkyl group having from 9 to 15 carbon atoms and A is a primary, secondary or tertiary, linear or branched, aliphatic or cyclic amine having from 2 to 8 carbon atoms and, 3%–20% by weight, of at least a compound having formula:

$$X—(CO)_n—OH \quad (II)$$

wherein n is 1 or zero and wherein X is a linear, branched or cyclic alkyl or alkyenyl group containing from 6 to 25 carbon atoms.

2. Compositions, according to claim 1, wherein the amount of component (c) ranges between 1% and 6% by weight.

3. Compositions, according to claim 1, wherein the amount of component (a) ranges between 79% and 97.5% by weight.

4. Compositions, according to claim 1, wherein the amount of component (b) ranges between 1.5% and 15% by weight.

5. Compositions, according to claim 1, wherein component (c) comprises from 88% to 94% by weight of at least a compound having formula (I) and from 6% to 12% by weight of at least a compound having formula (II).

6. Compositions, according to claim 1, wherein in the compounds of formula (I), R is an undecyl, dodecyl or tredecyl radical, and A is isopropylamine or t.butylamine.

7. Compositions, according to claim 1, wherein the compounds of formula (II) are linear or branched, saturated or unsaturated, fatty carboxylic acids, containing from 12 to 18 carbon atoms.

8. Compositions, according to claim 1, wherein the compounds of formula (II) are aliphatic or cycloaliphatic alcohols containing from 8 to 16 carbon atoms.

* * * * *